United States Patent [19]

Csoka

[11] 4,200,290

[45] Apr. 29, 1980

[54] GAME DEVICE

[75] Inventor: Frank S. Csoka, Sea Cliff, N.Y.

[73] Assignee: Fun Things, Inc., New York, N.Y.

[21] Appl. No.: 860,328

[22] Filed: Dec. 14, 1977

[51] Int. Cl.[2] ..... A63F 9/08

[52] U.S. Cl. ..... 273/139

[58] Field of Search ..... 273/153 R, 139, 138 R, 273/138 A, 106 R, 106 E; 124/48; 35/22 A; 206/379

[56] References Cited

U.S. PATENT DOCUMENTS

| | | | |
|---|---|---|---|
| 910,769 | 1/1909 | Archibald | 273/139 |
| 1,877,643 | 9/1932 | Brown | 35/22 A |
| 2,131,807 | 10/1938 | Jerum | 206/379 X |
| 2,491,404 | 12/1949 | Winnemore | 35/22 A |
| 2,625,927 | 1/1953 | Rosenbloom | 124/48 X |
| 2,942,887 | 6/1960 | Kirk | 273/139 |
| 2,971,275 | 2/1961 | Provenzano | 35/22 A UX |
| 3,175,825 | 3/1965 | Ehret | 273/138 A X |
| 3,500,556 | 3/1970 | Moskowitz | 35/22 A |
| 3,643,290 | 2/1972 | Milne | 35/22 A UX |

OTHER PUBLICATIONS

Filing System for Drills, Bakelite Review, Apr. 1947, p. 21.

*Primary Examiner*—Richard C. Pinkham
*Assistant Examiner*—Arnold W. Kramer
*Attorney, Agent, or Firm*—Marvin Feldman; Stephen E. Feldman

[57] ABSTRACT

A game device for chance play is disclosed which comprises:

- a base;
- a body rotatably mounted on said base and being formed with a plurality of holes of a first size and another hole of a second size;
- a plurality of members sized to receive in said plurality holes but not fitting into said another hole; and
- another member sized to be received in both said plurality of holes and said another hole.

The game device is played by inserting all the members in the plurality of holes but not the differently sized hole, and then spinning the body. When the body stops spinning, one player selects a member and tries to insert it into the differently sized hole. The game continues until one player selects the one member that fits.

8 Claims, 3 Drawing Figures

GAME DEVICE

FIELD OF USE OF THE INVENTION

This invention relates to a game device. Specifically, this invention relates to a game device in which chance selection determines the end of the game.

DISCUSSION OF PRIOR ART

In Doan et al, U.S. Pat. No. 873,031, granted Dec. 10, 1907 there is disclosed a game with discs wherein the player with skill discerns the differently sized discs from each other. Another such learning device with pegs and holes is disclosed in Hollien, U.S. Pat. No. 1,145,417, granted July 6, 1915.

Certain later developed games, such as the U.S. patents to Glass et al, No. 3,479,035, granted Nov. 14, 1969 and Coby, No. 3,709,500, granted Jan. 9, 1973, disclose placing a peg of one size into a hole of one size, in a hidden chance manner select an operating mechanism. Such operating mechanisms were often costly and subject to malfunction.

Now there is provided by the present invention a game device in which a member or peg is differently sized from others to a degree which while not discernible to the naked eye does provide a telling fit in a specifically sized aperture, so that the selection of the one peg remains solely a matter of probability regardless of the numerous games played.

It is therefore an object of this invention to provide a game device in which the player physically selects one member from others, without detecting the size differential of the members.

It is a further object of this invention to provide a game device as aforesaid in which the members fit into one set of holes but only the one differently sized member fits into another hole, to end the game.

It is another object of this invention to provide a game device as aforesaid in which the probability of selecting the differently-sized peg increases as the game progresses, to heighten the excitement of the game.

It is another object of this invention to provide a construction which permits numerous games to be played without physically marking the members.

It is another object of this invention to provide a game apparatus as aforesaid in which the inserted part of the members are differently-sized but the uninserted part of the members are similarly sized in part.

It is also an object of this invention to provide a game device as aforesaid which is readily constructed and yet is safe and practical in use.

The aforesaid as well as other objects and advantages as will become apparent from a reading of the following specification, the adjoined claims, and the accompanying drawings in which:

Figure 1:
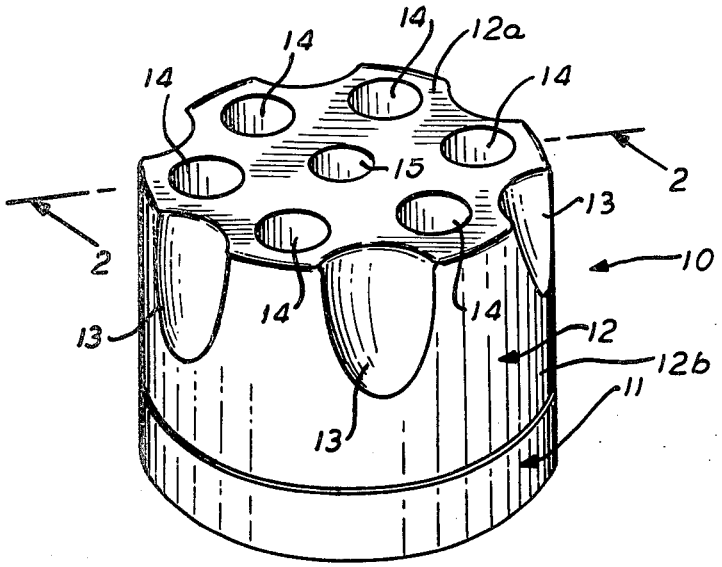
FIG. 1 is the front and rear perspective view of the game device.
Figure 2:
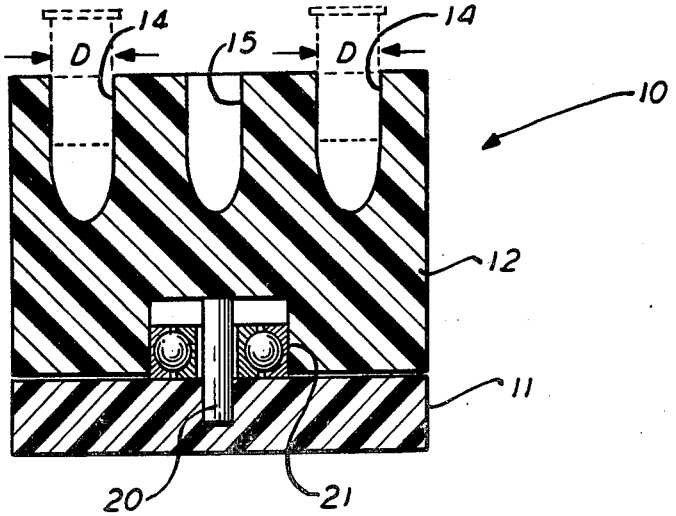
FIG. 2 is a sectional view taken along 2—2 of FIG. 1.

Referring to FIGS. 1 and 2, the game device is generally designated as 10, and broadly comprises a flat cylindrical base 11, and a generally cylindrical body 12 rotatably mounted on said base. The rotation means comprises a shaft 20 on base 11 and a ball bearing assembly 21 in body 12; the shaft and bearing assembly being of well-known construction. Base 11 and body 12 have the same cylinder diameters. Body 12 is formed with six, equally-sized identations 13 at the top 12*a* and side 12*b* of the body. The indentations 13, to some degree simulate the shape of the indentations on a revolver, and in this invention are useful in gripping the body 13 to spin the body.

A series of six, equally-spaced, equally-sized, radially-disposed holes 14 are formed in the top 12*a* of body 13. The diameter of holes 14 is 0.500 inch. An axially disposed hole 15 is also formed at top 12*a* and while being of the same depth as hole 14 is smaller in diameter; being 0.497 in. in diameter.

Figure 3:
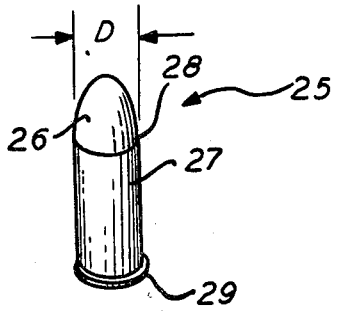
FIG. 3 is a perspective view of the bullet-shaped member of this invention.

Referring to FIG. 3, there is shown a bullet-shaped member (i.e., "bullet") 25 comprising a rounded front end 26, a body portion 27, a circumferential ridge 28, and a rear end 29, all of the aforesaid being integrally formed of one-piece molded plastic construction. Portion 27 has a diameter D and end 29 has a diameter larger than D. Generally speaking, the bullet and hole diameter will be from about $\frac{3}{8}$ to $\frac{3}{4}$ inch.

The game device 10, comprising six members 25, five of said members being identical, and the sixth being similarly sized and shaped except having a smaller D than the aforementioned five members. Specifically, the D of the first five members is 0.498 in. and that of the sixth member is 0.492 inch. All members have an overall length from front end 26 to rear end 29 of 1.5 inches. The difference in diameters of bullets 25 is 0.005 inch. The inserted bullet extends $\frac{3}{4}$ inch from top 12*a*.

In this manner of construction all of the six members 25, will fit front end down into holes 14 to the same depth, but only the sixth member of small D will fit into central hole 15 of smaller diameter than holes 14.

Basically to render the diameter differences not discernible to the naked eye, the difference in diameters D of the members divided by the average diameter of the members may be about 0.01 in./in., and in a broad sense, 0.001 in./in. to 0.05 in./in. The diameter of the rear end 29 of all members 25 is the same so as to give the impression that all the members are identical when in fact that is not the case.

In playing this game, all six members or bullets 25 are inserted into holes 14 with hole 15 vacant. A first player spins body 12 and allows the body to come to rest and then selects one bullet 25 and attempts to insert that bullet into hole 15. If the bullet fits, the player win and the game is over, if the bullet does not fit, it is discarded from play. The second player then in turn spins the body until it comes to rest and selects one of the remaining five bullets and attempts to insert it into the center hole 15. Thusly, the game continues until one player in turn selects the differently-sized bullet and inserts it into the center hole. With several plays the probability of selection of the differently sized bullet of course increases, heightening the tension of the game. The game is usually played by two players but more players may join, or the game can be played by one player.

It has been generally found that because of the small diameter variation in bullet 25, that attempts to jiggle the bullet in the hole to sense the size variation before selection are not successful to one of ordinary physical senses.

The game device of this invention, specifically, the body and bullets may be constructed of any suitable material, but preferably it is of a plastic which has a low coefficient of friction and which is not readily marred, so that with repeated plays, there is no scratching or marring of the bullets to permit distinguishing one from the other. Suitable plastics include the moldable thermoset and thermoplastics, including by way of example polyethylene, polypropylene, polystyrene, polymethylmethacrylate and the like.

While the aforesaid game is a preferred embodiment, other preferred embodiments are useful such as where the holes and bullets are sized so that the differently sized bullet does not fit the central hole, but the plurality of identically sized bullets do fit the central hole, the sizes being converse to the aforesaid.

Such variations and modifications as are illustrative of the inventive concept are considered to be a part of the invention as represented by the appended claims.

What is claimed is:

1. A game device comprising:

a base;

a body rotatably mounted on said base and being formed with a plurality of holes of a first size and another hole of a second size;

a plurality of members each of said members comprising a body portion and a enlarged top portion, said body portions being sized to be received in said plurality of holes but not fitting into said another hole; and another member comprising a body portion and a top portion, said another member body portion being differently sized from said body portions of said plurality of members so as to be received in both said plurality of holes and said another hole, said top portions comprising similarly appearing portions and wherein the differences in size of said differently sized body portions are not discernible to the naked eye, whereby only by selection of members with attempted fitting into said another hole determines which member is said another member.

2. The game device of claim 1, wherein said holes are round, and said members are cylindrical, and wherein the difference in diameters between said holes sizes divided by the average diameter of body portions is from about 0.001 to 0.05 in./in.

3. The game device of claim 1, said members being bullet-shaped, and said holes being shaped to receive the front ends of said bullet-shaped members, with the other end of the bullets extending upwardly from the body so as to be gripped by a player.

4. The game device of claim 2, the difference in the diameter of said members being about 0.005 in.

5. The game device of claim 1, said members being cylindrical and having a diameter of about $\frac{3}{8}$ to $\frac{3}{4}$ inch.

6. The game device of claim 1, said members and said body being formed of plastic so that said members are not scratched with a plurality of insertions and removal with said holes.

7. The game device of claim 1 the body of said device being cylindrical and being formed with a plurality of indentations formed at the top periphery of said body so as to be gripped by the user in rotating the body.

8. A game device comprising:

a base;

a body rotatably mounted on said base and being formed with a plurality of holes of a first size and another hole of a second size;

a plurality of members each of said members comprising a body portion and a enlarged top portion, said body portions being sized to be received in said plurality holes and fitting into said another hole; and another member comprising a body portion and a top portion, said another member body portion being differently sized from said body portions of said plurality of members so as to be received in said plurality of holes, but not said another hole, said top portions comprising similarly appearing portions and wherein the difference in size of said differently sized body portions are not discernible to the naked eye, whereby only by selection of members with attempted fitting into said another hole determines which member is said another member.

* * * * *